US005346563A

United States Patent [19]

Allen et al.

[11] Patent Number: 5,346,563

[45] Date of Patent: Sep. 13, 1994

[54] METHOD FOR REMOVING SULFUR FROM SUPERALLOY ARTICLES TO IMPROVE THEIR OXIDATION RESISTANCE

[75] Inventors: William P. Allen, Portland; Norman S. Bornstein, West Hartford; Stephen Chin, Wallingford; Michael DeCrescente, Wethersfield; David N. Duhl, Newington; Donald R. Parille, South Windsor; Roscoe A. Pike, Granby; John G. Smeggil, Simsbury, all of Conn.

[73] Assignee: United Technologies Corporation, Hartford, Conn.

[21] Appl. No.: 47,253

[22] Filed: Apr. 14, 1993

Related U.S. Application Data

[63] Continuation-in-part of Ser. No. 796,981, Nov. 25, 1991, abandoned.

[51] Int. Cl.[5] ..... C22F 1/10

[52] U.S. Cl. ..... 148/675; 75/10.17; 75/10.18; 75/10.45; 75/10.47; 75/10.54; 75/628; 148/708; 148/710; 148/712; 427/405

[58] Field of Search ..... 148/675, 708, 710, 712, 148/285; 75/10.18, 10.45, 10.47, 10.54, 17.17, 628; 428/632, 639, 649; 427/405, 419.2, 419.3

[56] References Cited

U.S. PATENT DOCUMENTS

| | | | |
|---|---|---|---|
| 1,710,846 | 4/1929 | Smith et al. | 75/628 |
| 2,823,139 | 2/1958 | Schulze et al. | 427/405 |
| 3,403,058 | 9/1968 | Pollock | 148/712 |
| 3,853,540 | 12/1974 | Schlatter et al. | 75/628 |
| 3,891,425 | 6/1975 | McCarty | 75/10.17 |
| 4,209,348 | 6/1980 | Duhl et al. | 148/555 |
| 4,719,080 | 1/1988 | Duhl et al. | 420/443 |
| 4,895,201 | 1/1990 | DeCrescente et al. | 164/56.1 |

OTHER PUBLICATIONS

Corrosion & Particle Erosion at High Temperatures, by V. Srinivasan and K. Vedula, editors; The Minerals, Metals & Materials Society (1989); "Effect of Sulfur Removal on Scale Adhesion to PWA 1480", by B. K. Tubbs and J. L. Smialek (p. 459).

Adherent $Al_2O_3$ Scales Formed on Undoped NiCrAl Alloys by James L. Smialek, Metallurgical Transactions A, vol. 18A, Jan. 1987, pp. 164–167.

*Primary Examiner*—Richard O. Dean
*Assistant Examiner*—Robert R. Koehler
*Attorney, Agent, or Firm*—Charles E. Sohl

[57] ABSTRACT

Superalloy articles are made more oxidation resistant by a process which includes heat treating the article in the presence of foreign chemical species, at a temperature at which the foreign chemical species reacts with and modifies any oxide film present on the article surface. The heat treatment is best carried out at a temperature above the gamma prime solvus temperature of the article and below the incipient melting temperature of the article. Alternatively, the heat treatment may be carried out within the range defined by the incipient melting temperature of the article and about 150° C. below the incipient melting temperature of the article. At such temperatures the foreign chemical species reacts with and modifies the oxide film on the article surface. Sulfur is then able to diffuse through such modified film, and a more oxidation resistant component is produced.

39 Claims, 1 Drawing Sheet

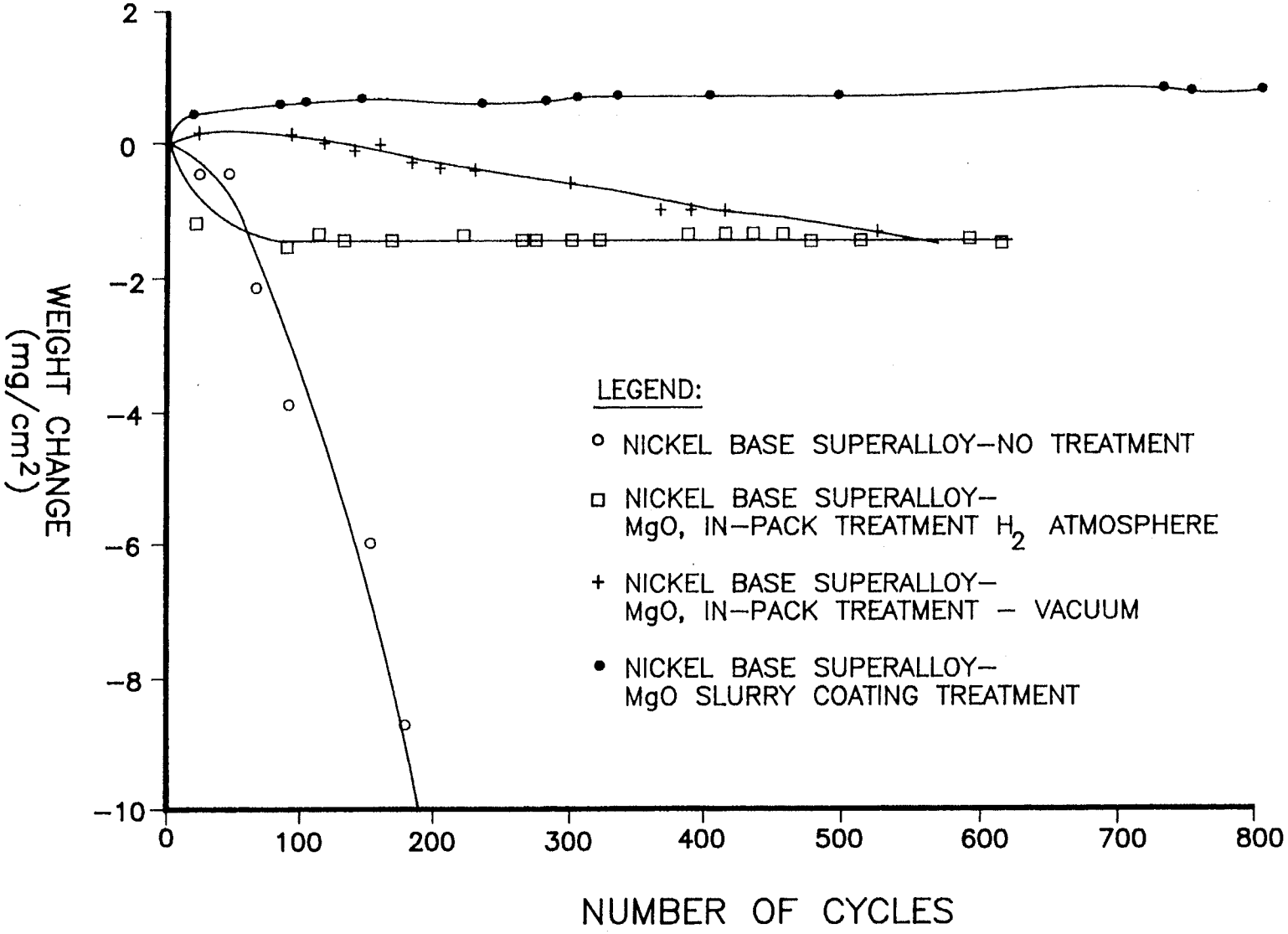
LEGEND:
o NICKEL BASE SUPERALLOY—NO TREATMENT
□ NICKEL BASE SUPERALLOY—MgO, IN—PACK TREATMENT $H_2$ ATMOSPHERE
+ NICKEL BASE SUPERALLOY—MgO, IN—PACK TREATMENT — VACUUM
● NICKEL BASE SUPERALLOY—MgO SLURRY COATING TREATMENT
WEIGHT CHANGE (mg/cm2)
2
0
−2
−4
−6
−8
−10
NUMBER OF CYCLES
0
100
200
300
400
500
600
700
800

METHOD FOR REMOVING SULFUR FROM SUPERALLOY ARTICLES TO IMPROVE THEIR OXIDATION RESISTANCE

This application is a continuation-in-part of application Ser. No. 07/796,981, filed on Nov. 25, 1991, and now abandoned.

CROSS REFERENCE TO RELATED APPLICATIONS

This application contains subject matter common with copending and commonly assigned Ser. No. 07/797,664 and Ser. No. 07/797,657, both applications filed on Nov. 25, 1991 and both applications now abandoned.

1. Technical Field

This invention pertains to methods to improve the oxidation resistance of superalloy articles. In particular, the invention pertains to methods for removing sulfur from nickel base superalloy articles to improve their oxidation resistance.

2. Background Art

Superalloys are widely used in gas turbine engines, spacecraft engines, and other engines and machines which operate at high temperatures and stress levels. Castings made from such superalloys must have, as a minimum, two important properties: mechanical strength and resistance to oxidation at high temperatures. Unfortunately, the optimization of one property is often at the expense of the other. The highest strength superalloys do not have the best resistance to oxidation, and the most oxidation resistant superalloys do not have the best strength levels.

Efforts by researchers in the superalloy field have identified compositions which have the potential of providing a very good combination of strength and oxidation resistance. Cast components having such compositions include critical amounts of aluminum and/or titanium as well as oxygen active elements such as yttrium and hafnium. However, research to date has not been entirely successful in identifying cost effective means for reproduceably retaining the needed amounts of oxygen active elements in the casting.

The oxygen active element yttrium has long been used in coatings and more recently in alloys to improve oxidation behavior, but the method by which it improved oxidation resistance was not fully understood. Researchers have recently learned that yttrium produces its beneficial effect by immobilizing the sulfur which is inevitably present in the casting as an impurity. Free or mobile sulfur degrades an article's oxidation resistance by weakening the adherence of the protective oxide film which forms on the article's surface at high temperatures. Unfortunately, the known means for controlling the level of sulfur in superalloy castings such as those described in DeCrescente et al., U.S. Pat. No. 4,895,201, have been found to generally be expensive and difficult to implement in industry.

Accordingly, what is needed in the superalloy field are high strength, low sulfur superalloy articles and methods for making them.

DISCLOSURE OF THE INVENTION

This invention is based on the discovery that a heat treatment process can economically and effectively remove sulfur from superalloy articles, thereby significantly improving the oxidation resistance of the articles.

According to this invention, superalloy articles are made more oxidation resistant by a process which includes heat treating the article in the presence of a foreign chemical species, for example MgO, at a temperature at which the foreign chemical species reacts with and modifies any oxide film present on the article surface. The heat treatment is best carried out at a temperature above the gamma prime solvus temperature of the article and below the incipient melting temperature of the article. Alternatively, the heat treatment may be carried out within the range defined by the incipient melting temperature of the article and about 150° C. below the incipient melting temperature of the article.

At such temperatures the foreign chemical species reacts with and modifies the oxide film on the article surface. Sulfur is then able to diffuse through such modified film, and a more oxidation resistant component is produced.

Other advantages, features and embodiments of the invention will be apparent from the following description of the best mode as read in light of the drawing.

BRIEF DESCRIPTION OF DRAWING

The FIGURE is a graph of weight change as a function of time, and shows the superior cyclic oxidation resistance of superalloy articles heat treated in accordance with the invention.

BEST MODE FOR CARRYING OUT THE INVENTION

The invention is directed to a method for making oxidation resistant superalloy articles. As used in this application, the term superalloy is used in the conventional sense, and describes the class of alloys specifically developed for use in high temperature environments and having a yield strength in excess of 100 ksi at 1,000° F. Representative of such class of metal alloys include the nickel base superalloys containing aluminum and/or titanium which are strengthened by solution heat treatment and which usually contain chromium and other refractory elements such as tungsten and tantalum. Such alloys also usually contain greater than 5 parts per million, by weight("ppm"), sulfur as an undesired impurity. Two such nickel base superalloys are known as PWA 1480 (see U.S. Pat. No. 4,209,348 to Duhl et al.) and PWA 1484 (see U.S. Pat. No. 4,719,080 to Duhl et al.). Other nickel base superalloys are known to those skilled in the art; see the book entitled "Superalloys II" Sims et al. ed., published by John Wiley & Sons, 1987.

The invention is effective in improving the oxidation resistance of nickel base superalloy articles by reducing the sulfur content of such articles to a level which is less than about 5 ppm. Because sulfur degrades the superalloy's oxidation resistance by reducing the adherence of the protective oxide film which forms on the article surface at high temperatures, reducing the level of sulfur in the article improves the article's oxidation resistance by improving the adherence of the protective oxide film.

Since diffusion of sulfur through such an oxide film is very sluggish, effective desulfurization of nickel base superalloys is dependent upon either avoiding the presence of an oxide film, often $Al_2O_3$, on the article surface during treatment or modifying the normally forming oxide film, thereby rendering the film more permeable to sulfur diffusion. Typically, the invention reduces the sulfur level to below about 3 ppm sulfur, and most preferably, to below about 1 ppm sulfur. Below about 5 ppm sulfur, nickel base superalloy articles have good oxidation resistance; below about 3 ppm sulfur, nickel base superalloy articles have very good oxidation resistance; below about 1 ppm sulfur, nickel base superalloy articles have excellent oxidation resistance. The above mentioned sulfur levels are as measured by either glow discharge mass spectroscopy (GDMS) utilizing a device such as the VG-9000, a product of Vacuum Generators, or combustion analysis using the LECO CS-444-LS a product of LECO, although other methods will be known by those skilled in the art.

The method of this invention comprises the steps of heating the nickel base substrate in the presence of a foreign chemical species, for example MgO, to a temperature at which sulfur in the article becomes mobile and the foreign chemical species reacts with any oxide film which has formed on the article surface to modify the film thereby permitting the sulfur to readily diffuse out of the article. Based upon diffusion theory, for a 20 mil thick nickel based superalloy sample processed at 1100° C. for about 25 hours, the sulfur content would be decreased from more than 5 ppm to about 0.5 ppm, with a diffusion coefficient for sulfur in the nickel-base superalloy of approximately $6.8\times10^{-9}$ $cm^2/sec$. For other alloys the time and/or temperature may need to be adjusted to achieve approximately the same rate of sulfur diffusion.

As used in this specification, the term "foreign chemical species" means the class of elements and/or compounds, and mixtures thereof, which modify the oxide film thereby allowing the sulfur to diffuse out of the article more rapidly. Typically, a foreign chemical species will fall into one or more of the following categories, using $Al_2O_3$ as the exemplary oxide film:

1. those elements or compounds containing metallic cations which segregate to $Al_2O_3$ grain boundaries to modify the oxide film and thereby increase the rate of sulfur diffusion under the intended operating conditions of the present invention;
2. those elements or compounds which react with any $Al_2O_3$ present to form an $Al_2O_3$ containing compound, such as a spinel, which exhibits an increased rate of sulfur diffusion relative to $Al_2O_3$ under the intended operating conditions of the present invention; and
3. those elements or compounds in which $Al_2O_3$ exhibits a solubility of at least 1 mol % under the intended operating conditions of the present invention.

The intended operating conditions of the present invention are from about 1,050° C. to about 1,370° C. in either a vacuum, inert gas (e.g. argon or helium), or reducing atmospheres (e.g. hydrogen containing), or some combination thereof (e.g. 90% Ar 10% H) . The foreign chemical species should also exhibit vapor pressures of about $10^{-8}$ to $10^{-3}$ bar under the aforementioned operating conditions. Foreign chemical species which exhibit the above mentioned vapor pressures are beneficial in that they allow for vapor phase transport to all surfaces of the article.

The foreign chemical species may be an oxide such as MgO, $Fe_2O_3$, $Cr_2O_3$, BaO, CaO, NiO, $Li_2O$, $Na_2O$, FeO, $Ta_2O_5$, $Y_2O_3$, $Gd_2O_3$, $SiO_2$, $ZrO_2$, $Ga_2O_3$, and CoO; or other elements/compounds which act to increase the diffusivity of sulfur through the $Al_2O_3$ such as AlN, $Al_4C_3$, $Ni_2Mg$, $NiMg_2$, $Co_2Mg$, $MgCl_2$, $MgF_2$, Fe, and spinels such as $MgAl_2O_4$ and $MgZrAl_2O_6$.

In carrying out the invention, various forms of the foreign chemical species may be used. The preferred source is a solid, the most preferred solid source is in the form of powder particles. When using powder particles, the invention may be carried out by embedding the article in a mixture of such particles, and heating the article in a vacuum, an inert, or hydrogen gas reducing atmosphere, the atmosphere also having a low partial pressure of oxygen, to a temperature sufficient to enable the foreign chemical species to react with and modify any oxide film which has formed on the article surface. Sulfur is then able to readily diffuse through such a modified film to reduce the sulfur content in the article and produce a more oxidation resistant component. Carded out in this fashion, the method would be considered an in-pack method.

The invention may also be carried out by arranging the article in out-of-contact relationship with the foreign chemical species, and then heating in the manner just described.

The article may also be made more oxidation resistant by a process which includes applying a coating which contains the foreign chemical species, for example MgO, to the article surface. The coating may be applied by various methods including, but not limited to, vapor depositing the coating or by preparing a slurry containing the powder particles.

When coating the article with the slurry, the desired thickness of the applied coating will be dependent on the cross-section and surface to volume ratio of the article, since thicker articles and/or articles with lower surface to volume ratios require a longer amount of time for desulfurization. If the slurry coating is not thick enough it may evaporate before the desulfurization process is complete. Typically, the article will be coated with a slurry at least 10 mils thick. The slurry preferably contains a surfactant, typical of those known in the art, to wet the surface of the powder particles. The slurry can be applied to the article by spraying, brushing, or dipping. Other application techniques known to those skilled in the art are equally useful, as well as other liquid carders for the particles. The coated article is then heated to drive off the liquid carder and produce a dry, adherent coating on the article surface. Finally, the article is heated in a vacuum, an inert, or hydrogen gas reducing atmosphere, the atmosphere also having a low partial pressure of oxygen, to a temperature sufficient to enable the foreign chemical species to react with and modify any oxide film which has formed on the article surface, and for the sulfur to diffuse through such modified film to reduce the sulfur content in the article and produce a more oxidation resistant component.

One advantage of the three methods of the disclosed invention is that the article does not require additional cleaning prior to heat treatment. A key advantage of the out-of-contact (or out-of-pack) technique is its utility in treating articles having hollow internal passages, such as exists in blades and vanes used in gas turbine engines. Using the out-of-contact method, vapors are generated by the foreign chemical species during heat treatment, which vapors are able to easily flow through the internal passages (as well as to react with the surfaces which define the external portion of the article). Contact and reaction of the vapors with the internal and external surfaces of the article allows sulfur to diffuse through these surfaces, thereby accelerating the removal of sulfur from the article.

Another advantage of the present invention is that the desulfurization process may be combined with solution heat treatment of the article. If the article is solution heat treated then after heating, in order to produce an article with good mechanical properties, the article is cooled at a rate which is at least as fast as the cooling rate following the normal solution heat treatment for the article. For most superalloys, the cooling rate following normal solution heat treatment is at least about 55° C. per minute. If the desired cooling rate is not attainable, the normal solutioning treatment for the article should be performed after the heat treating method of this invention.

The source may include constituents in addition to the foreign chemical species, as long as such constituents do not detrimentally impact the reaction of the foreign chemical species with the surface oxide or the diffusion of sulfur from the article. Examples of such sources are magnesia powder as well as mixtures of magnesia and alumina powder.

Foreign chemical species in a purely gaseous state may also be utilized in carrying out the invention. Such foreign chemical species include halides of magnesium such as $MgCl_2$ and $MgF_2$. These materials are introduced into the heat treatment chamber via conventional chemical vapor deposition methods, or similar such methods, and are particularly effective in treating parts having hollow internal passages.

In each of the embodiments of the invention, the article is considered as being heated in the presence of the foreign chemical species if the use of the foreign chemical species facilitates the removal of sulfur from the article. This is true whether the article is in contact, out-of-contact, or coated with the foreign chemical species, or whether the foreign chemical species is in the form of solid particles, a gas, or any other form, or combination thereof.

The superalloy article is heated in the presence of the foreign chemical species to a temperature at which the foreign chemical species reacts with and modifies any oxide film which has formed on the article surface and allows the sulfur to diffuse out of the article. The rate at which such processes take place is a function of the temperature and time of the heat treatment, the relative sulfur activities in the workpiece and the atmosphere, furnace conditions, and the rate of sulfur diffusion from the workpiece.

The minimum temperature at which the processes take place in a practical period of time is about 100° C. below the article's gamma prime solvus temperature or about 150° C below the article's melting point. The maximum temperature for carrying out the invention is the article's incipient melting temperature. The gamma prime solvus temperature is the temperature at which the gamma prime phase goes into solution in the gamma phase matrix. Generally speaking, the gamma prime solvus temperature for nickel base superalloy castings is from about 1,150° C. to about 1,300° C. (from about 2,100° F to about 2,370° F.). The incipient melting temperature for nickel base superalloy casting is generally from about 1,230° C to about 1,370° C. (from about 2,250° F. to about 2,500° F.).

The heat treating environment for carrying out the method of this invention should either be vacuum, an inert or reducing gas such as commercial purity argon or commercial purity hydrogen, or some mixture of gases such as 90% Ar 10% H. Typically, the heat treatment will be carried out for no more than 200 hours, with 50 hours being a typical time period for acceptable heat treatment, due primarily to economic considerations. All times are approximate and cumulative. At the completion of the heat treatment, the article contains no more than 5 ppm sulfur, preferably less than 3 ppm sulfur, and most preferably less than 1 ppm sulfur.

The following example will illustrate additional features and aspects of this invention. The example is not to be construed as a limitation on the scope of the invention.

Single crystal nickel-base superalloy turbine blades having a hollow airfoil portion and a thicker root portion and also having compositions, on a weight percent basis, of 10Co—5.9W—1.9Mo 8.7Ta—5.6Al—3-Re—5Cr0.1Hf—balance Ni, a melting temperature of about 1340° C, gamma prime solvus temperature of about 1305° C., and containing about 8 to 10 ppm sulfur (as determined by GDMS) were processed according to this invention. This is a known, high strength superalloy composition, and is described in more detail in the above referenced patent '080 to Duhl et al. The airfoil portions were cleaned in a conventional laboratory fashion by grinding the surface with silicon-carbide paper and were then immersed in −325 mesh MgO powder within a MgO crucible. The crucible was placed in a resistively heated furnace which had graphite heating elements. The furnace maintained a vacuum with a pressure of approximately 0.05 torr, and the operating environment was static, i.e. there was no gas flow in or out of the system. The turbine blades were then heated to a temperature from about 1,200 to 1,300° C. and held within such a range for approximately 100 hours. After the aforementioned heat treatment, the sulfur content in the airfoil portions was measured by GDMS and determined to be less than 1 ppm.

Turbine blades having the same composition as described above were also heat treated in the same type of MgO powder and MgO crucible, but in a furnace operated at 3psig (915 torr) with a constant flow of about 200 cubic centimeters per minute of commercial purity hydrogen gas. The heating elements in this furnace were metallic. The turbine blades were heated to a temperature from about 1,200 to about 1,300° C. and held within such a range for approximately 100 hours. After the aforementioned heat treatment, the sulfur content in the airfoil portions was measured by GMDS and determined to be less than 1 ppm.

Turbine blades having the same composition as described above were also heat treated, but a water base slurry coating containing a surfactant and −325 mesh MgO powder was applied to the surface of the airfoil portions prior to heat treatment by dipping the airfoil portions into the slurry and then baking the turbine blades at about 200° C. in air for 5 minutes to dry off the water. The turbine blades were placed in a furnace having metallic heating elements and a constant flow of pure hydrogen gas at a pressure of about 3 torr. The turbine blades were heated to a temperature of about 1300° C and held at such a temperature for approximately 50 hours. After the aforementioned heat treatment, the sulfur content in the airfoil portions was measured by a LECO CS-444-LS combustion analyzer and determined to be less than 1 ppm. Virtually identical results were obtained when cleaned airfoils having the same composition as described above were heat treated with a MgO vapor deposited coating treatment.

Although heat treatments under the above operating conditions produced airfoils with low sulfur contents and therefore good oxidation resistance, furnaces utilizing metallic heating elements sometimes produced better results, since graphite heating elements will sometimes produce carbon monoxide which could conceivably degrade certain mechanical properties in the specimen.

Samples having the same composition as above and subject to the same heat treatment were evaluated to measure their cyclic oxidation resistance, a common and important measurement for superalloy castings used in the gas turbine engine industry, and a qualitative measurement of sulfur in the casting. In these tests, the samples were cycled between 55 minutes at 1,180° C. and 5 minutes at room temperature; one cycle is comprised of the 55 and 5 minute combination. The results of the tests are shown in the Figure, where large weight losses are indicative of spallation of the protective oxide film and poor cyclic oxidation performance. Conversely, lower weight losses indicate better oxidation resistance. The Figure shows that the samples which were heat treated in accordance with this invention exhibit very little weight loss, as compared to samples which received no heat treatment. Airfoils heat treated in accordance with this invention, therefore, have excellent resistance to oxidation. Some samples processed in accordance with the invention actually gained weight during testing, which is indicative of the formation of an adherent, protective oxide .film. The tests indicate the close correlation between reduced sulfur content in superalloy castings and excellent oxidation resistance.

Although this invention has been shown and described with respect to detailed embodiments thereof, it will be understood by those skilled in the art that various changes in form and detail thereof may be made without departing from the spirit and scope of the claimed invention. For example, while the invention is usually carried out on cast articles, it will also be useful in removing sulfur from wrought or forged articles, as well as articles made by powder metallurgy. In addition, although $Al_2O_3$ was the exemplary oxide film in describing this invention, the invention will also be useful with other oxide films such as $Cr_2O_3$.

What is claimed is:

1. A method for removing sulfur from a solid nickel-base superalloy article, said article having a normally occurring alumina surface film, comprising the step of heating the article in the presence of a source of magnesium at a temperature at which magnesium in the source reacts with the alumina film thereby enabling said sulfur to diffuse out of the article.

2. The method of claim 1, wherein the article is embedded in the magnesium source during the heating step.

3. The method of claim 1, wherein the article is in out-of-contact relation with the magnesium source during the heating step.

4. The method of claim 1, wherein a coating comprising the magnesium source is applied to the article surface prior to the heating step.

5. The method of claim 4, wherein the coating is a slurry.

6. The method of claim 1, wherein the magnesium source is pure magnesium.

7. The method of claim 1, wherein the magnesium source is a compound which contains magnesium.

8. The method of claim 1, wherein the article is heated to a temperature within the range defined by the incipient melting temperature of the article and about 100° C. below the gamma prime solvus temperature of the article.

9. The method of claim 1, wherein the article is heated to temperature within the range defined by the incipient melting temperature of the article and about 150° C. below the incipient melting temperature of the article.

10. The method of claim 1, wherein the heating step is carried out in a vacuum.

11. The method of claim 1, wherein the heating step is carried out in a hydrogen atmosphere.

12. The method of claim 1, wherein the heating step is carried out in an inert gas atmosphere.

13. A method for removing sulfur from a solid nickel base superalloy article, comprising the steps of embedding the article in powder particles which comprises source of magnesium, and then heating embedded the article in vacuum or in a hydrogen or inert gas atmosphere to a temperature within the range defined by the melting temperature of the article and about 100° C. below the gamma prime solvus temperature of the article for a period of time sufficient to reduce the sulfur in the article to below about 5 parts per million, by weight.

14. A method for removing sulfur from a nickel base superalloy article, comprising the steps of arranging the article in out-of-contact relation with a source of magnesium, and then heating the article, and the magnesium source, in vacuum or in a hydrogen or inert gas atmosphere to a temperature within the range defined by the incipient melting temperature of the article and about 100° C. below the gamma prime solvus temperature of the article for a period of time sufficient to reduce the sulfur in the article to below 5 parts per million, by weight.

15. A method for removing sulfur from a nickel base superalloy article, comprising the steps of applying a coating which includes a source of magnesium to the article surface, and then heating the coated article in a vacuum or in a hydrogen or inert gas atmosphere to a temperature within the range defined by the incipient melting temperature of the article and about 100° C. below the gamma prime solvus temperature of the article for a period of time sufficient to reduce the sulfur in the article to below 5 parts per million, by weight.

16. A method for removing sulfur from a nickel base superalloy article, comprising the step of heating the article in the presence of a foreign chemical species, said foreign chemical species being effective in modifying any oxide present on the article surface at elevated temperatures to allow sulfur to diffuse out of the article, and then heating the article to a temperature at which the sulfur present in the article becomes mobile and said foreign chemical species reacts with the oxide present on the article surface to modify said oxide to allow said sulfur to diffuse out of the article.

17. The method of claim 16, wherein said foreign chemical species includes metallic cations and segregates to the surface oxide's grain boundaries thereby promoting increased sulfur diffusion, at elevated temperatures.

18. The method of claim 17, wherein said elevated temperatures are within the range defined by the incipient melting temperature of the article and approximately 150° C. below the melting temperature of the article.

19. The method of claim 17, wherein said elevated temperatures are within the range defined by the melting temperature of the article and about 100° C. below the gamma prime solvus temperature of the article.

20. The method of claim 17, wherein said foreign chemical species exhibits a vapor pressure between about $10^{-8}$ to about $10^{-3}$ bar within said temperature range.

21. The method of claim 16, wherein said foreign chemical species reacts with any surface oxide present to form a surface oxide containing compound thereby promoting increased sulfur diffusion at elevated temperatures.

22. The method of claim 21, wherein said elevated temperatures are within the range defined by the incipient melting temperature of the article and approximately 150° C. below the melting temperature of the article.

23. The method of claim 21, wherein said elevated temperatures are within the range defined by the incipient melting temperature of the article and about 100° C. below the gamma prime solvus temperature of the article.

24. The method of claim 21, wherein said foreign chemical species exhibits a vapor pressure between about $10^{-8}$ to about $10^{-3}$ bar within said temperature range.

25. The method of claim 16, wherein any surface oxide present on said article is soluble in said foreign chemical species at elevated temperatures.

26. The method of claim 25, wherein said elevated temperatures are within the range defined by the incipient melting temperature of the article and approximately 150° C. below the incipient melting temperature of the article.

27. The method of claim 25, wherein said elevated temperatures are within the range defined by the incipient melting temperature of the article and about 100° C. below the gamma prime solvus temperature of the article.

28. The method of claim 25, wherein said foreign chemical species exhibits a vapor pressure between about $10^{-8}$ to about $10^{-3}$ bar within said temperature range in order to promote vapor phase transport.

29. The method of claim 16, wherein the article is embedded in said foreign chemical species during the heating step.

30. The method of claim 16, wherein the article is in out-of-contact relation with said foreign chemical species during the heating step.

31. The method of claim 16, wherein the article is coated with said foreign chemical species prior to the heating step.

32. The method of claim 31, wherein said coating is a slurry.

33. The method of claim 16, wherein the heating step is carried out in a vacuum.

34. The method of claim 16, wherein the heating step is carried out in a hydrogen reducing atmosphere.

35. The method of claim 16, wherein the heating step is carried out in an inert gas atmosphere.

36. The method of claim 16, wherein said foreign chemical species is a material selected from the group consisting of AlN, $Al_4C_3$, $Li_2O$, $Na_2O$, BaO, CaO, MgO, FeO, NiO, CoO, $Y_2O_3$, $Gd_2O_3$, $SiO_2$, $ZrO_2$, $Cr_2O_3$, $Fe_2O_3$, $Ga_2O_3$, $Ni_2Mg$, $NiMg_2$, $Co_2Mg$, $MgCl_2$, $MgF_2$, $MgAl_2O_4$, $MgZrAl_2O_6$, $Ta_2O_5$, and Fe.

37. A method for improving the oxidation resistance of a nickel base superalloy article, comprising the steps of embedding the article in a powdered foreign chemical species, said foreign chemical species being effective in modifying any oxide present on the article surface at elevated temperatures, and wherein said foreign chemical species exhibits a vapor pressure between about $10^{-8}$ to about $10^{-3}$ bar at a temperature within the range defined by the incipient melting temperature of the article and approximately 150° C. below the incipient melting temperature of the article, and then heating the embedded article in vacuum or in a hydrogen reducing or inert gas atmosphere to a temperature within said range for a period of time sufficient to allow the foreign chemical species to react with any oxide present on the article surface to modify said oxide to allow said sulfur to diffuse out of the article to reduce the sulfur in the article.

38. A method for improving the oxidation resistance of a nickel base superalloy article, comprising the steps of arranging the article in out-of-contact relation with a foreign chemical species, said foreign chemical species being effective in modifying any oxide present on the article surface at elevated temperatures, and wherein said foreign chemical species exhibits a vapor pressure between about $10^{-8}$ to about $10^{-3}$ bar at a temperature within the range defined by the incipient melting temperature of the article and approximately 150° C. below the melting temperature of the article, and the magnesium source, and then heating the article in vacuum or in a hydrogen or inert gas containing atmosphere to a temperature within said range for a period of time sufficient to allow the foreign chemical species to react with any oxide present on the article surface to modify said oxide to allow said sulfur to diffuse out of the article to reduce the sulfur in the article.

39. A method for improving the oxidation resistance of a nickel base superalloy article, comprising the steps of applying a coating which includes a foreign chemical species to the article surface, said foreign chemical species being effective in modifying any oxide present on the article surface at elevated temperatures, and wherein said foreign chemical species exhibits a vapor pressure between about $10^{-8}$ to about $10^{-3}$ bar at a temperature within the range defined by the incipent melting temperature of the article and approximately 150° C. below the incipient melting temperature of the article, and then heating the coated article in vacuum or in a hydrogen reducing or inert gas atmosphere to a temperature within said range for a period of time sufficient to allow the foreign chemical species to react with any oxide present on the article surface to modify said oxide to allow said sulfur to diffuse out of the article to reduce the sulfur in the article.

* * * * *